US005277784A

United States Patent [19]

Woo

[11] Patent Number: 5,277,784

[45] Date of Patent: Jan. 11, 1994

[54] MANUFACTURING METHOD FOR A VACUUM FLUORESCENT DISPLAY

[75] Inventor: Sang-Mo Woo, Kyungki, Rep. of Korea

[73] Assignee: Samsung Electron Devices Co., Ltd., Kyungki, Rep. of Korea

[21] Appl. No.: 950,885

[22] Filed: Sep. 25, 1992

[30] Foreign Application Priority Data

Sep. 25, 1991 [KR] Rep. of Korea ..... 91-16720

[51] Int. Cl.[5] ..... C25D 15/00

[52] U.S. Cl. ..... 205/109; 205/122

[58] Field of Search ..... 205/109, 122

[56] References Cited

U.S. PATENT DOCUMENTS 5,032,234 7/1991 Oku ..... 205/125

*Primary Examiner*—T. M. Tufariello

*Attorney, Agent, or Firm*—Leydig, Voit & Mayer

[57] ABSTRACT

A manufacturing method for a vacuum fluorescent display is performed by the steps of dividing a substrate into a plurality of areas, and sequentially forming a signal line, an insulating layer, and a segment electrode on each area, arranging common wiring layers with a predetermined distance therebetween on the substrate to be electrically connected to all signal lines formed on the substrate, submerging the substrate into a container filled with a dispersed fluorescent material, and settling the fluorescent material on the segment electrode by applying power to the common wiring layers, and forming rear plates by cutting the substrate having the fluorescent material settled thereon into the plurality of individual areas. A separate settling jig is not required, and cost for the formation of the settling jig and manpower for its handling can be reduced, so that productivity is enhanced.

2 Claims, 1 Drawing Sheet

MANUFACTURING METHOD FOR A VACUUM FLUORESCENT DISPLAY

BACKGROUND OF THE INVENTION

The present invention relates to a manufacturing method for a vacuum fluorescent display, and more particularly to a method for forming fluorescent layers on anodes.

A general vacuum fluorescent display is schematically illustrated in FIG. 1. Here, a rear plate 10*a* and a face plate 10*b* form a vacuum space by keeping a predetermined separation distance by means of a plurality of side plates 10*c*. A plurality of segment electrodes 11 as anodes having a predetermined pattern are provided on the inner surface of rear plate 10*a*, and fluorescent layers 12 are formed on segment electrodes 12. Also, filaments 14 are provided over fluorescent layer 12 as cathodes for emitting thermoelectrons, and a grid 13 for controlling and accelerating the thermoelectrons is formed between segment electrode 11 and filament 14. Signal lines 15 protected by an insulating layer 16 are arranged on the surface of rear plate 10*a*, for the communication with segment electrode 11, grid 13, and filament 14.

In the vacuum fluorescent display constructed as above, the method for forming the typical fluorescent layer comprises the steps of dividing one substrate into a plurality of areas; sequentially forming signal line 15, insulating layer 16, and segment electrode 11 on each area; cutting the substrate into individual areas to form a plurality of rear plates 10*a*; mounting rear plates 10*a* on a separate settling jig; and providing electrical communication to the rear plates by submerging the settling jig into a container filled with a dispersed fluorescent material, and in doing so, allowing the fluorescent material to completely settle on segment electrode 11 of each rear plate 10*a*.

However, in such a conventional method for forming the fluorescent display, since the fluorescent layer is formed on the rear plate by means of the settling jig, an exclusive settling jig for each model is required which raises the manufacturing cost of end product due to the respective settling jigs. In addition to this, the settlement and the subsequent separation of the rear plate on the settling jig is cumbersome, and represents an increased number of production steps, thereby lowering productivity.

SUMMARY OF THE INVENTION

The present invention is devised to solve the above problems. It is the object of the present invention to provide a manufacturing method for a vacuum fluorescent display capable of simply forming a fluorescent layer without requiring a settling jig.

To achieve the above object of the present invention, there is provided a manufacturing method for a vacuum fluorescent display comprising the steps of:

dividing a substrate into a plurality of areas, and sequentially forming a signal line, an insulating layer, and a segment electrode on each area;

arranging common wiring layers on the substrate to be electrically connected to all signal lines formed on the substrate, while being spaced apart from each other by a predetermined distance;

submerging the substrate into a container filled with a dispersed fluorescent material, and settling the fluorescent material on the segment electrode by applying power to the common wiring layers; and forming rear plates by cutting the substrate having the fluorescent material settled thereon into the plurality of individual areas.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
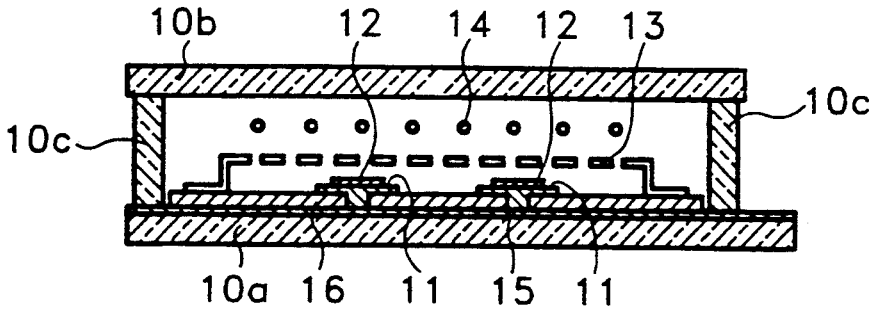
FIG. 1 is a sectional view showing a general vacuum fluorescent display to which the present invention and prior art are applied.
Figure 2:
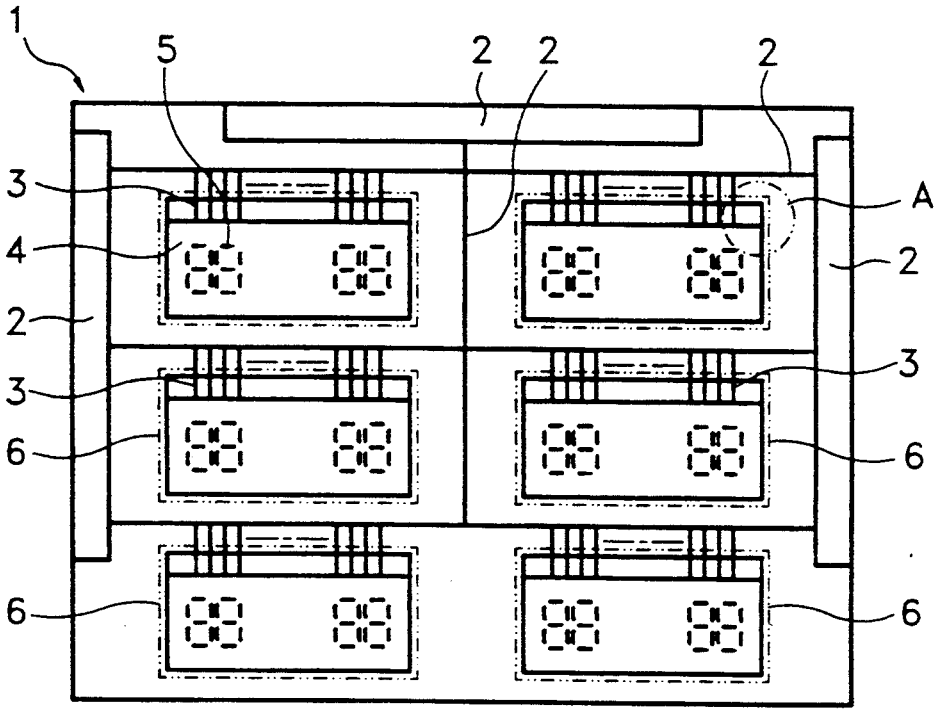
FIG. 2 is a plan view for illustrating a manufacturing method for a vacuum fluorescent display according to the present invention.
Figure 3:
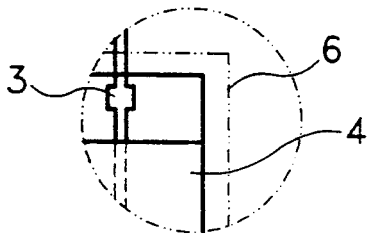
FIG. 3 is an enlarged view of a portion A shown in FIG. 2.

Referring to FIGS. 2 and 3, a manufacturing method for a vacuum fluorescent display according to the present invention is as follows. A substrate 1 is classified into a plurality of areas, and a signal line 3, an insulating layer 4, a segment electrode 5 as an anode are sequentially formed on each area in conformity with a predetermined pattern. Then, while keeping a predetermined separation distance, common wiring layers 2 are arranged on substrate 1, for electrical connection with all signal lines 3 which are formed on substrate 1. Also, substrate 1 is submerged in a container having a fluorescent material, and power is applied to common wiring layers 2 to settle the fluorescent material on segment electrode 5. Applying a first voltage potential (i.e. a power voltage potential) to segment electrode 5 and a second voltage potential (i.e. a common voltage potential) to the fluorescent material, causes the fluorescent material to settle on segment electrode 5. Thus, in this manner the fluorescent material is settled on a surface of segment electrode 5 using the well known technique of electrodeposition. Thereafter, substrate 1 is cut along a cutting line 6 for each area, thereby forming respective rear plates.

In the manufacturing method for a vacuum fluorescent display as described above, the manufacturing operation is simplified and a separate settling jig is not required, as compared with the conventional method wherein the fluorescent layer is settled on the rear plate in such a manner that the signal line, insulating layer, the segment electrode is formed on each area of the substrate which is then cut into individual rear plates, and a settling jig mounting the rear plates is submerged into the container filled with the dispersed fluorescent.

As a result, the manufacturing method for a vacuum fluorescent display according to the present invention is simple, such that the number of the production steps can be reduced, which increases productivity. Furthermore, the separate settling jig is not required, thereby reducing the cost of the formation of the settling jig as well as the man power for its handling.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A manufacturing method for a vacuum fluorescent display comprising the steps of:

dividing a substrate into a plurality of areas, and sequentially forming a signal line, an insulating layer, and a segment electrode on each area;

arranging common wiring layers with a predetermined distance therebetween on said substrate to be electrically connected to all signal lines formed on said substrate;

submerging said substrate in a container filled with a dispersed fluorescent material, and settling said fluorescent material on said segment electrode by applying power to said common wiring layers; and forming rear plates by cutting said substrate having said fluorescent material settled thereon into the plurality of individual areas.

2. A manufacturing method for a vacuum fluorescent display as recited in claim 1, including applying a common voltage potential to the fluorescent material, so as to settle the fluorescent material on a surface of the segment electrode using electrodeposition.

* * * * *